US010144439B2

(12) United States Patent
Hillmer et al.

(10) Patent No.: US 10,144,439 B2
(45) Date of Patent: Dec. 4, 2018

(54) REDUNDANCY SWITCHING OF DETECTION POINTS

(71) Applicant: Thales Deutschland GmbH, Ditzingen (DE)

(72) Inventors: Frank Hillmer, Ludwigsburg (DE); Rainer Klemm, Steinheim (DE)

(73) Assignee: THALES DEUTSCHLAND GMBH, Ditzingen (DE)

( * ) Notice: Subject to any disclaimer, the term of this patent is extended or adjusted under 35 U.S.C. 154(b) by 187 days.

(21) Appl. No.: 15/219,216

(22) Filed: Jul. 25, 2016

(65) Prior Publication Data

US 2016/0332644 A1 Nov. 17, 2016

Related U.S. Application Data

(63) Continuation of application No. PCT/EP2015/050832, filed on Jan. 19, 2015.

(30) Foreign Application Priority Data

Jan. 27, 2014 (EP) ..... 14152717

(51) Int. Cl.
*B61L 1/02* (2006.01)
*B61L 1/16* (2006.01)

(52) U.S. Cl.
CPC ..... *B61L 1/162* (2013.01); *B61L 1/161* (2013.01); *B61L 1/165* (2013.01); *B61L 1/169* (2013.01)

(58) Field of Classification Search
CPC ..... B61L 1/00; B61L 1/02; B61L 1/14; B61L 1/16; B61L 1/161; B61L 1/162
See application file for complete search history.

(56) References Cited

U.S. PATENT DOCUMENTS 7,258,309 B2 * 8/2007 Ehrsam ..... B60M 3/00 104/299
8,005,585 B2 * 8/2011 Klemm ..... B61L 1/162 246/247

(Continued)

FOREIGN PATENT DOCUMENTS

CN 1375421 A 10/2002
CN 101039834 A 9/2007

(Continued)

OTHER PUBLICATIONS

Fuss W.: "Die elektronische Stellwerksloesung (Thales Elektra) im Loetschberg-Basistunnel", Signal + Draht, Telzlaff Verlag GMBH, Darmstadt, DE; vol. 100, No. 3, Mar. 1, 2008, pp. 23-28, XP001510911, ISSN: 0037-4997, section 2.3.

(Continued)

*Primary Examiner* — Robert J McCarry, Jr.
(74) *Attorney, Agent, or Firm* — Hackler, Daghighian, Martino & Novak

(57) ABSTRACT

A method for operating an axle counter system for monitoring the occupation status of a track section being limited by counting positions which have at least one detection point and at least one counting position a set of redundant detection points, includes the steps of: (a) incrementing or decrementing axle counter values in dependence of the moving direction of a passing axle; (b) transmitting the axle counter value to an axle counter evaluator; (c) determining the number of remaining axles within the track section; and (d) outputting a track occupation status. Prior to step (c) for each counting position exactly one detection point is selected for further processing independent of the selection at any other counting position. In step (c) the counter values of the selected detection points are used for determining the num- (Continued)

ber of remaining axles and the counter values of the non-selected redundant detection points are ignored.

19 Claims, 8 Drawing Sheets

(56) References Cited

U.S. PATENT DOCUMENTS

| | | | |
|---|---|---|---|
| 2006/0224357 | A1 | 10/2006 | Taware et al. |
| 2010/0256874 | A1 | 10/2010 | Carresjoe et al. |
| 2013/0119978 | A1 | 5/2013 | Freise |

FOREIGN PATENT DOCUMENTS

| | | | |
|---|---|---|---|
| CN | 101189155 | A | 5/2008 |
| CN | 101311681 | A | 11/2008 |
| CN | 101878122 | A | 11/2010 |
| CN | 102985792 | A | 3/2013 |
| DE | 101 28 762 | A1 | 12/2002 |
| DE | 10 2005 048 852 | A1 | 4/2006 |
| EP | 2 289 757 | A2 | 3/2011 |
| EP | 2289757 | A2 | 3/2011 |
| GB | 788 453 | A | 1/1958 |
| WO | 2006/040137 | A1 | 4/2006 |
| WO | 2006 125595 | A1 | 11/2006 |
| WO | 2010 000850 | A1 | 1/2010 |

OTHER PUBLICATIONS

Wander D. et al: "Die Sicherungsanlage fur den Gotthard-Basistunnel im Labortest", Signal + Draht, Telzlaff Verlag GMBH, Darmstadt, DE; vol. 103, No. 12, Dec. 1, 2011, pp. 6-11, XP001570278, ISSN: 0037-4997, p. 7, left-hand column, paragraph 2.

Wei Xie, et al., "A design implementation for a dual redundancy train axel counting system", Chinese Railways, Nov. 30, 2010, No. 11.

* cited by examiner

REDUNDANCY SWITCHING OF DETECTION POINTS

CROSS-REFERENCE TO RELATED APPLICATIONS

This continuation application claims priority to PCT/EP2015/050832 filed on Jan. 19, 2015 which has published as WO 2015/110371 A1 and also the European Patent Application 14152717.6 filed on Jan. 27, 2014, the entire contents of which are fully incorporated herein with these references.

DESCRIPTION

Field of the Invention

The invention concerns a method for operating an axle counter system for monitoring the occupation status of a given track section, the track section being limited by counting positions, wherein at least one counting-in-position and at least one counting-out-position is provided, wherein at each counting position at least one detection point is provided and at least one counting position a set of redundant detection points is provided, said method comprising:

(a) incrementing or decrementing axle counter values by means of the detection points in dependence of the moving direction of a passing axle;
(b) transmitting the axle counter value of each detection point to an axle counter evaluator;
(c) determining the number of remaining axles within the track section by means of the axle counter evaluator by comparing the axle counter values at the counting-in-positions with those at the counting-out-positions; and
(d) outputting a track occupation status report in dependence of the number of remaining axles within the track section.

Background of the Invention

Such a method is known from DE 10 2005 048 852 A1.

Axle counters are devices on railways that detect passing trains and are used to determine if a section of a railway track is clear or occupied by a train.

Double sensors, called detection points monitor axles entering a section. As an axle passes a sensor a voltage pulse ("wheel pulse") is induced at the detection point thereby changing an initial voltage. As soon as one of the sensors is influenced, the section is reported occupied for safety reasons. The two sensors of a detection point have to be mounted close enough together that they both will be influenced by a single wheel with an overlap in time, but far enough from each other to make sure that a moving wheel will influence both sensors with a time difference. Thereby the moving direction of a wheel or a train respectively can be determined by the axle counter systems. All axles moving into a section will increment an axle counter; all axles moving out of a section will decrement the axle-counter. If the net count is evaluated as zero, the section is presumed to be clear. This is carried out by safety relevant computers called 'evaluators' which are centrally located. The detection points are either connected to the evaluator via dedicated copper cable or via a telecommunications transmission system. This allows the detection points to be located significant distances from the evaluator.

In order to maintain undisturbed train traffic it is vital that these systems are both technically and functionally reliable. A widely spread method of ensuring no train is entering an occupied section is to set a section to 'occupied' whenever any disturbance of the counting system occurs.

The reasons for disturbances may be miscounts, the influencing of only one of the two sensors during shunting, a wheel that stops at a sensor when a train stops at a signal or malfunctions of the sensors themselves either due to technical defect or external influences.

A severe problem is that the section in which the disturbance occurs has to be cleared. Usually an employee of the train company has to inspect that section and declare it as being "clear". On tracks with heavy train traffic this will lead to severe interferences and delays.

Recent developments have been therefore aimed on avoiding the negative effects of the disturbances, for example by employing redundant systems.

DE 101 28 762 A1 introduces a method that tries to bypass a disturbed detection point by merging two consecutive sections into one longer section. Furthermore, this document also suggests the use of additional detection points (redundant detection points) and/or additional axle-counter evaluators. However, this method leads to longer sections and, thus, to less accurate and possibly less effective train management.

DE 10 2005 048 852 A1 introduces a device and method for determining axles in a track section. To achieve an error tolerance of the system, at each counting position two detection points are provided, mounted on either side of the track. In case a detection point is erroneous its results will be ignored and the occupation status of the track section will be calculated by comparing the axle counts of all working counting-in-detection-points with all working counting-out-detection-points.

This method is quite complicated due to the eventually high number of axle count sums to be considered for the determination of the occupation status.

The object of the present invention is to introduce an axle counter system and a method for operating said axle counter system that enable reliable and highly error-tolerant operation of train traffic on a railway track.

SUMMARY OF THE INVENTION

This objective is achieved in that prior to step (c) for each counting position exactly one detection point is selected for further processing independent of the selection at any other counting position, that in step (c) the counter values of the selected detection points are used for determining the number of remaining axles within the track section and that the counter values of the non-selected redundant detection points are ignored.

According to the invention for each set of redundant detection points a selection independent of other sets of redundant detection points is carried out. Therefore at each counting position the best working detection point can be used for determining the number of remaining axles within the track section.

A set of redundant detection point comprises at least two detection points (basic detection point and redundant detection point).

Along the track a reference direction is defined. Depending on whether a train moves along the reference direction or in opposite direction the axle counter value of a detection point is incremented or decremented.

The track section is limited by counting positions. At sites where a train enters the track section in reference direction (or leaves the track section in opposite direction) counting-in-positions are provided, whereas at sites where a train leaves the track section in reference direction (or enters the track section in opposite direction) counting-out-positions are provided. More specifically if a train passes a detection point at a counting-in-position along the reference direction the counter value is incremented. If a train passes a detection point at a counting-out-position along the reference direction the counter value is decremented. Any other counting rule known from state of the art axle counter systems can be applied.

A track section can comprise points or crossings, i.e. a train can enter and/or leave the track section in reference direction via more than one railway line. The track section therefore comprises more than two ends, each end being provided with a counting position. In case of more than N railway lines entering or leaving the track section, at least N counting positions (one for each rail entering the track section and one for each rail leaving the track section) are required for determining whether the track section is free or occupied.

The detection points counting out of a section can be used at the same time as count-in for the consecutive section.

A preferred variant of the inventive method is characterized in that a quality value is determined and the selection of the detection points is carried out in dependence of a quality value. Preferably the step of determining the quality value for each detection point is performed by means of the axle counter evaluator.

It is most advantageous if in case of an error an error message is transmitted by the erroneous detection point to the axle counter evaluator, wherein a quality factor is assigned to each error message in dependence of the relevancy of the error. The quality value for each detection point is then determined by adding the quality factors of the transmitted error messages of the respective detection point. The summation of the quality factors is carried out within a predetermined time frame. At the end of the time frame the quality value is reset to zero. The time frame is chosen such that a reset of the quality value is done between the passings of two trains, in particular less than 1 minute, e.g. 30 seconds.

Yet a further variant of the above variant is characterized in that the error messages are at least one of: defect warning (DFW) with quality factor QF1, wheel pulse without counting (ROZ) with quality factor QF2, drift warning (DRW) with quality factor QF3 and long wheel pulse (LRP) with quality factor QF4.

- A drift warning (DRW) is given out by a detection point if the initial voltage of one of the sensors is outside a predefined value;
- A wheel pulse without counting (ROZ) error message is given out by a detection point if only one sensor of a detection point has counted a wheel or if the drift of the initial voltage results in an absence of overlap in time, thus impending a determination of moving direction;
- A defect warning (DFW) is given out by a detection point if the detection point detected several wheel pulses without counting i.e. the detection point is not able to distinguish between a failure and normal train movement or if no overlap in time has been detected several times;
- A long wheel pulse (LRP) error message is given out by a detection point if at least one sensor registers a pulse of longer duration than a predefined value.

It is preferred to assign different quality factors to the different error messages, so that the following applies: $QF1 \neq QF2 \neq QF3 \neq QF4$.

It is highly advantageous to weight the error messages according to the relevancy of the error, i.e. $QF1 > QF2 > QF3 > QF4$, preferably $QF1:QF2:QF3:QF4 = 8:3:2:1$.

An alternative variant of the inventive method is characterized in that for each set of redundant detection points the difference between the axle counter values of the basic detection points and the related redundant detection point of a set of redundant detection points is determined, and that the selection of the detection points is carried out in dependence of the determined difference between the axle counter values, wherein the detection point having the higher axle counter value is selected, in case that the difference of the axle counter values exceeds a predefined threshold. In case that the difference does not exceed the predefined threshold, the selection of the detection points may be carried out in dependence of the quality value.

It is preferred that the selection of the detection points and the calculation of the number of remaining axles in the section is performed by a common axle counter evaluator.

The invention also includes an axle counter system for performing any one of the above mentioned methods, the axle counter system comprising detection points installed at counting positions along a track, wherein at each counting position at least one detection point is provided, and wherein at least one counting position a set of redundant detection points is provided, characterized in that all detection points are connected to one common axle counter evaluator, the axle counter evaluator being equipped for selecting the detection points and determining the number of remaining axles within the track section.

The wording "all detection points" include single detection points (one single detection point at a counting position) as well as basic and redundant detection points.

A preferred embodiment of the inventive axle counter system is characterized in that the axle counter evaluator is provided with means for determining a quality value.

In a further embodiment of the inventive axle counter system the axle counter evaluator comprises at least two, preferably three, independent data processors. This increases the error tolerance by providing redundancy.

It can be advantageous if the detection points of a set of redundant detection points (basic detection point and related redundant detection point) are installed at the same side of the track being spaced apart from each other. This may be the case if at a point or crossing there is no space for a mounting of the detection point on different sides of the track.

Alternatively and depending on the circumstances it may be preferable if the detection points of a set of redundant detection are installed at the opposite sides of the track. This setup can overcome problems concerning undesired induced signals, resulting from electrical devices on trains, which are often located on just one side of the train.

In both cases it is preferred to operate each of the sensors of any detection point on different frequencies. First of all it ensures that each receiver of the sensor is receiving the signal of the corresponding emitter. Additionally there may be external effects e. g. electrical devices on trains that cause induced signals at one of the frequencies. In this case the other sensor will still detect the correct number of axles.

BRIEF DESCRIPTION OF THE DRAWINGS

The invention is shown in the drawings and will be explained in detail using exemplary embodiments.

DETAILED DESCRIPTION OF THE PREFERRED EMBODIMENTS

Figure 1:
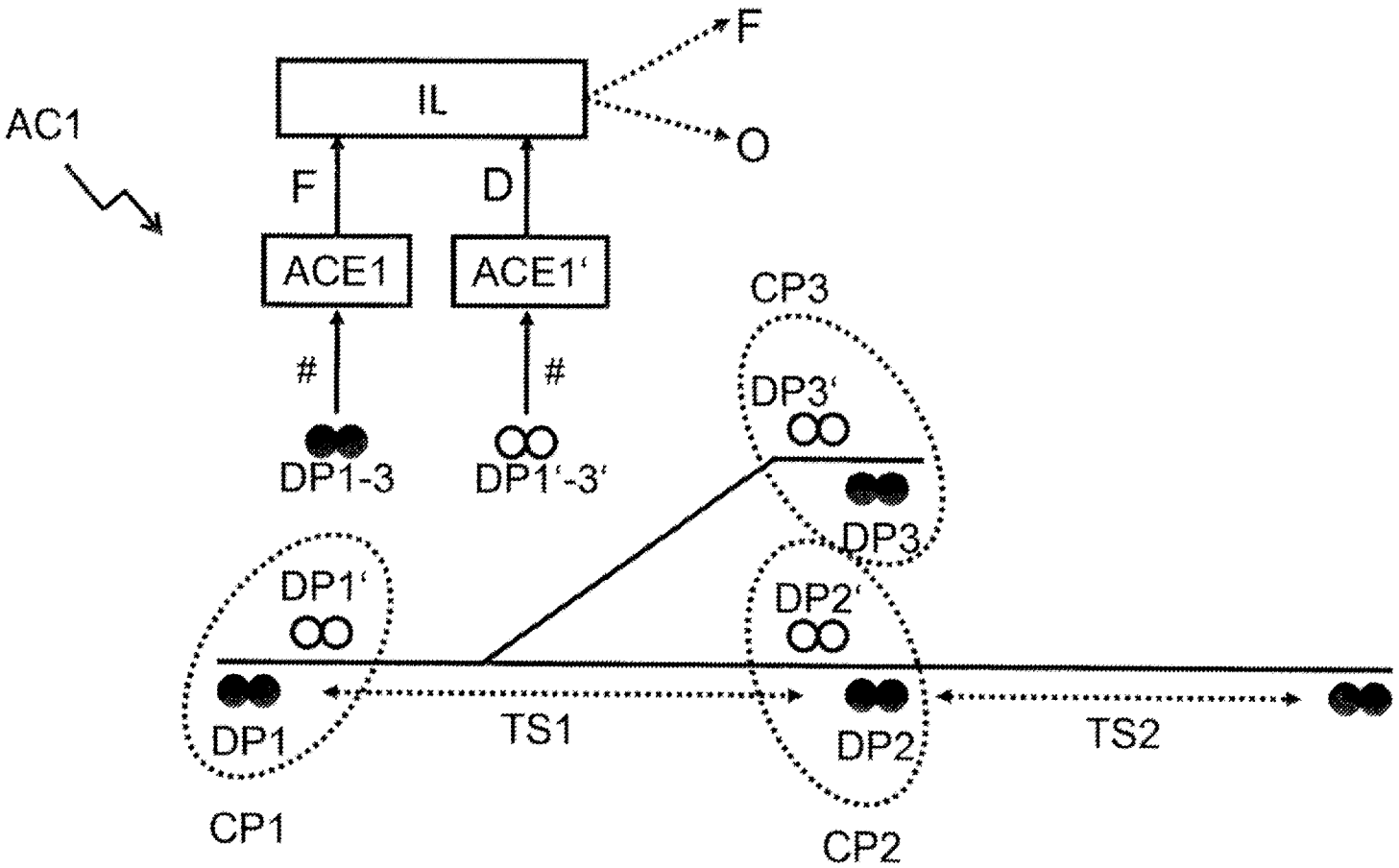
Fig. 1 Prior Art
FIG. 1 shows a schematic drawing of an axle counter system according to the state of the art.

FIG. 1 shows a schematic drawing of a common axle counter system AC1 according to the state of the art. For a train moving from left to right the first counting position CP1 serves as counting-in position into the first track section TS1, the counting position CP3 serves as counting-out position. Counting position CP2 is counting-out position out of track section TS1 and counting-in position to track section TS2. Detection points DP1, DP2, DP3 are positioned along the track. The counting positions CP1, CP2, CP3 are provided with additional detection points DP1', DP2', DP3'

The signal of the detection points DP1, DP2, DP3 is registered by a connected first axle counter evaluator ACE1. The signals of the additional detection points DP1', DP2', DP3' are registered by a connected second axle counter evaluator ACE1'. Both axle counter evaluators ACE1, ACE1' are determining an occupation status F, O and report their determined occupation status F, O to an associated interlock IL. The status can report the track to be free F or occupied O. Sometimes, however, a detection point DP1, DP2, DP3, DP1', DP2', DP3' is defective and an occupation status cannot be determined correctly. In this case the axle counter evaluator ACE1, ACE1' reports the track to be occupied O or it reports a defect D. At the interlock it is decided which occupation status F, O the track section TS1 is given. For safety reasons the status will be set to occupied O if the track status is unclear or cannot be determined.

Figure 2:
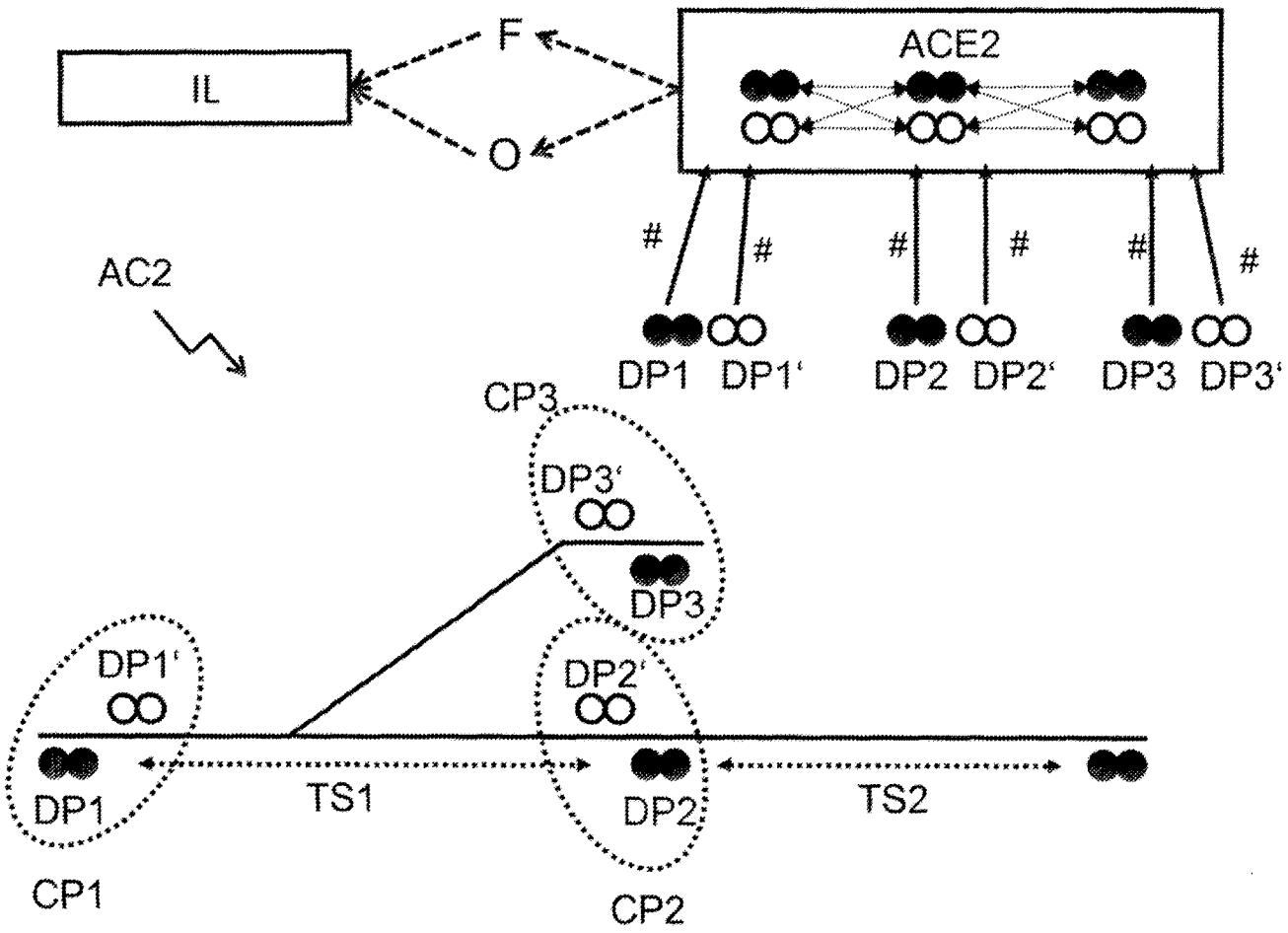
Fig. 2 Prior Art
FIG. 2 shows a schematic drawing of an error tolerant axle counter system according to the state of the art.

FIG. 2 shows a schematic drawing of another axle counter system AC2 known from the state of the art. All detection points DP1, RDP1, DP2, DP1', DP2', DP3' report to an axle counter evaluator ACE2. The axle counter evaluator ACE2 is determining the number of remaining axles for every combination of detection points DP1, DP2, DP3, DP1', DP2', DP3'.

This means:

#DP1+#DP2+#DP3
#DP1+#DP2'+#DP3
#DP1+#DP2'+#DP3'
#DP1+#DP2+#DP3'
#DP1'+#DP2+#DP3
#DP1'+#DP2'+#DP3
#DP1'+#DP'2+#DP3'
#DP1'+#DP2+#DP3' with # being the axle counter value of the particular detection point DP1, DP2, DP3, DP1', DP2', DP3'.

Ideally the 8 sums will be equal. The problem with this solution is which sum is to be trusted if the sums are not equal. The state of the art introduces decision routines to ensure a safe operation. In doubt, the track section will be reported occupied.

Figure 3:
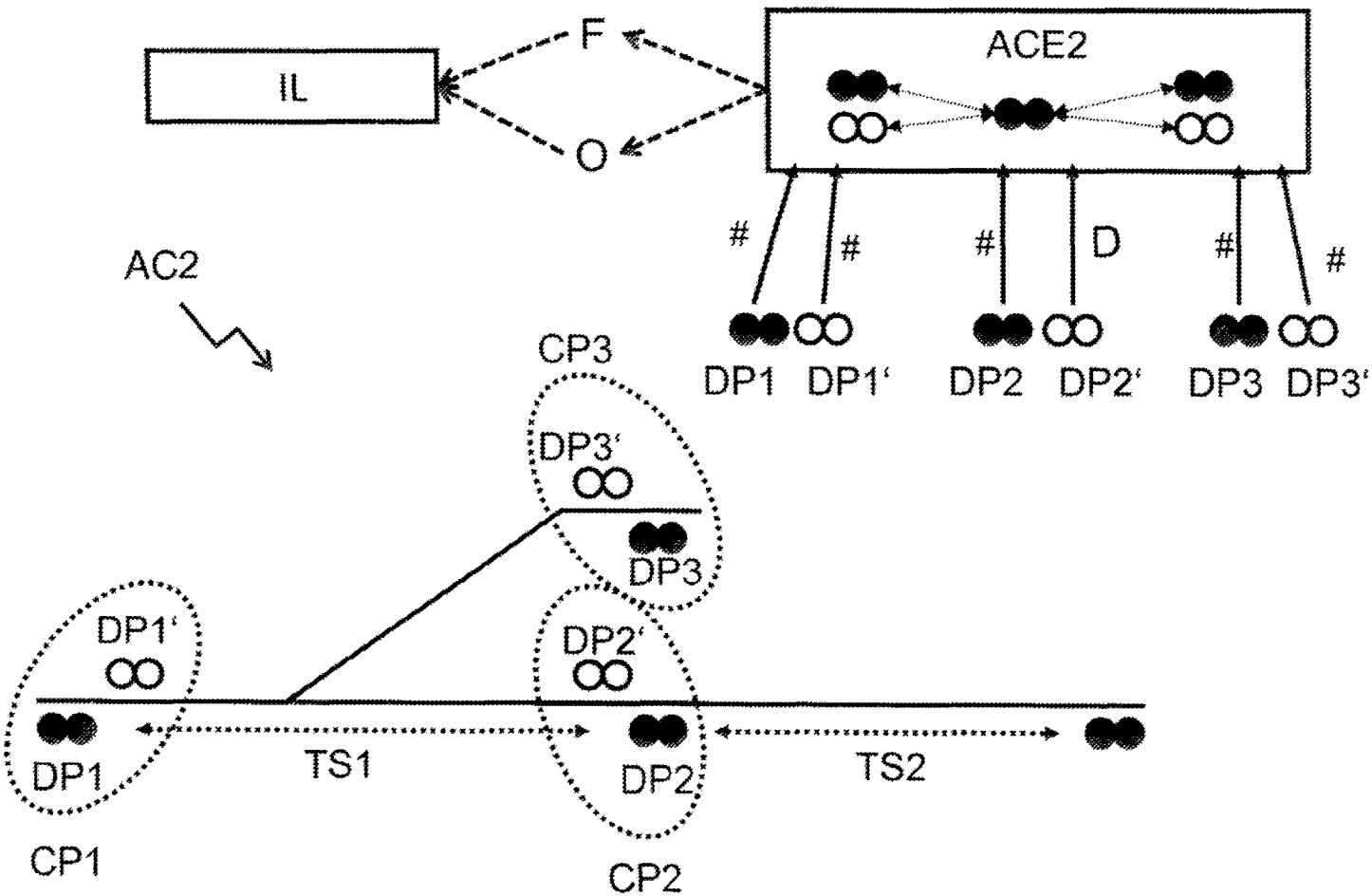
Fig. 3 Prior Art
FIG. 3 shows a schematic drawing of the axle counter system of FIG. 2 in case of an error.

FIG. 3 shows a schematic drawing of the same axle counter system AC2 as FIG. 2 with an obvious error in one of the detection points, (here additional detection point DP2'). In this case all sums resulting from the axle counter values of the erroneous detection point DP2' are excluded from the decision, which would leave four sums for the determination of the occupation status for the given example.

Figure 4:
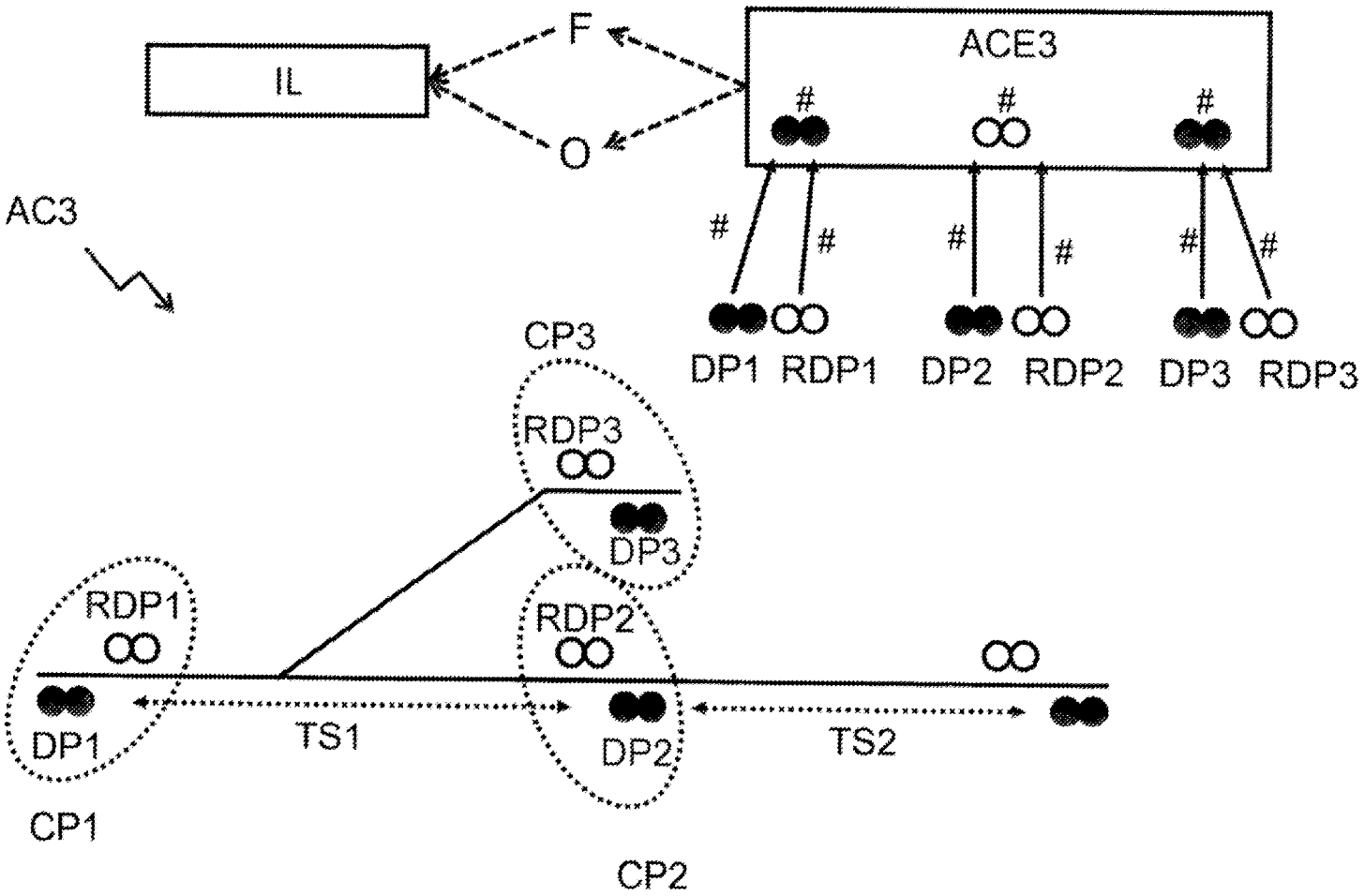
FIG. 4 shows a schematic drawing of an embodiment of the inventive axle counter system and method.

FIG. 4 shows a schematic drawing of an embodiment of an inventive axle counter system AC3. The axle counter system AC3 comprising counting positions CP1, CP2, CP3 along a track section TS1. In FIG. 4 at each counting position CP1, CP2, CP3 a set of redundant detection points is provided, each set comprising a basic detection point DP1, DP2, DP3 and a redundant detection point RDP1, RDP2, RDP3. Yet it should be mentioned that the inventive method also works if some counting positions are provided with only one detection point. In FIG. 4 the counting positions CP3 and CP2 are treated as counting-out positions; counting position CP1 is treated as counting-in position for track section TS1. According to the invention all detection points DP1, DP2, DP3, RDP1, RDP2, RDP3 are connected to one common axle counter evaluator ACE 3. For each counting position CP1, CP2, CP3 the axle counter evaluator ACE3 selects one detection point (either the basic detection point DP1, DP2, DP3 or the related redundant detection point RDP1, RDP2, RDP3). The selections are carried out independently from each other, i.e. for each counting position CP1, CP2, CP3 one detection point is selected which is taken into account for the further processing, independently of the selection result at any other counting position. Thereby the best working detection point DP1, DP2, DP3, RDP1, RDP2, RDP3 can be selected for each counting position CP1, CP2, CP3.

The axle counter values # of the selected detection points DP1, DP2, DP3, RDP1, RDP2, RDP3 (and only those of the selected detection points) are then used to determine the number of remaining axles within the track section TS1 by subtracting the axle counter values of the selected detection points RDP2, DP3 of all counting-out positions (here: CP2, CP3) from the axle counter value of the selected detection point DP1 of all counting in positions (here: CP1). For the example given in FIG. 4 the number of remaining axles would be: #DP1−(#RDP2+#DP3). In case another counting-in position DPX would exist, e.g. at a crossing (not shown in FIG. 4) the number of remaining axles would be: (#DP1+#DPX)−(#RDP2+#DP3). For trains moving in opposite direction, CP2 and CP3 are treated as counting-in positions and, to stick with the given example of FIG. 4, RDP2 and DP3 would be the selected detection points of the counting-in positions. Thus, the number of remaining axles would be: (#RDP2+#DP3)−#DP1.

If the calculated number of remaining axles is 0, the track section TS1 is considered to be free and the occupation status "free" F is transmitted to the interlock IL. Otherwise the occupation status "occupied" O is transmitted to the interlock IL.

In order to prevent the two sensors of a detection point DP1, DP2, DP3, RDP1, RDP2, RDP3 of influencing each other, the two sensors usually work on different frequencies. An often used setting is 28 kHz for one and 30 kHz for the other sensor. In order to prevent the sensors of the basic detection points DP1, DP2, DP3 to influence the sensors of the related redundant detection points RDP1, RDP2, RDP3 operating on the same frequency, the detection points of a counting position are positioned at a distance of approximately 2 m.

In FIG. 4 the basic detection points DP1, DP2, DP3 and the related redundant detection points RDP1, RDP2, RDP3 are therefore mounted on opposite sides of the track (at different rails of the track), with a small lateral offset. The lateral offset is not mandatory but can ensure an adequate distance between the DP1, DP2, DP3 and related redundant detection points RDP1, RDP2, RDP3.

Figure 5:
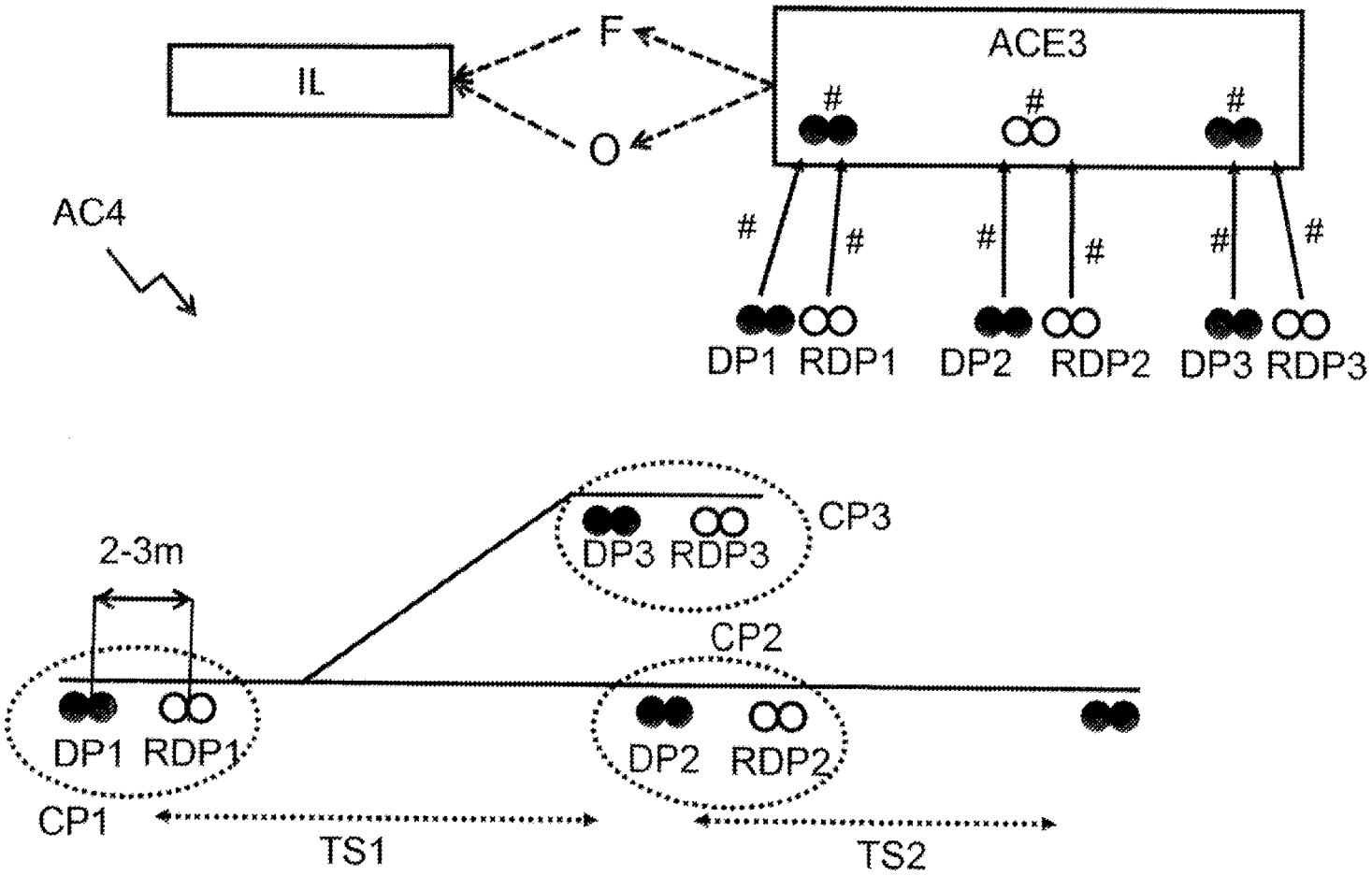
FIG. 5 shows a schematic drawing of another embodiment of the inventive axle counter system and method with the detection points being arranged on the same side of the track.

FIG. 5 shows a schematic drawing of another embodiment of the inventive axle counter system AC4, wherein the basic detection points DP1, DP2, DP3 as well as the redundant detection points RDP1, RDP2, RDP3 of the axle counter system AC4 are mounted on the same side of the track (at the same rail) with a lateral offset between the basic detection point DP1, DP2, DP3 and its related redundant detection point RDP1, RDP2, RDP3. The selection of the detection points and the evaluation of the number of remaining axles are carried out as described above.

In both cases the lateral offset has to be chosen small enough (preferably <3 m) to prevent a train or a part of a train (e.g. a complete lost wagon) standing in between the basic detection point and its related redundant detection point without being registered properly.

Figure 6:
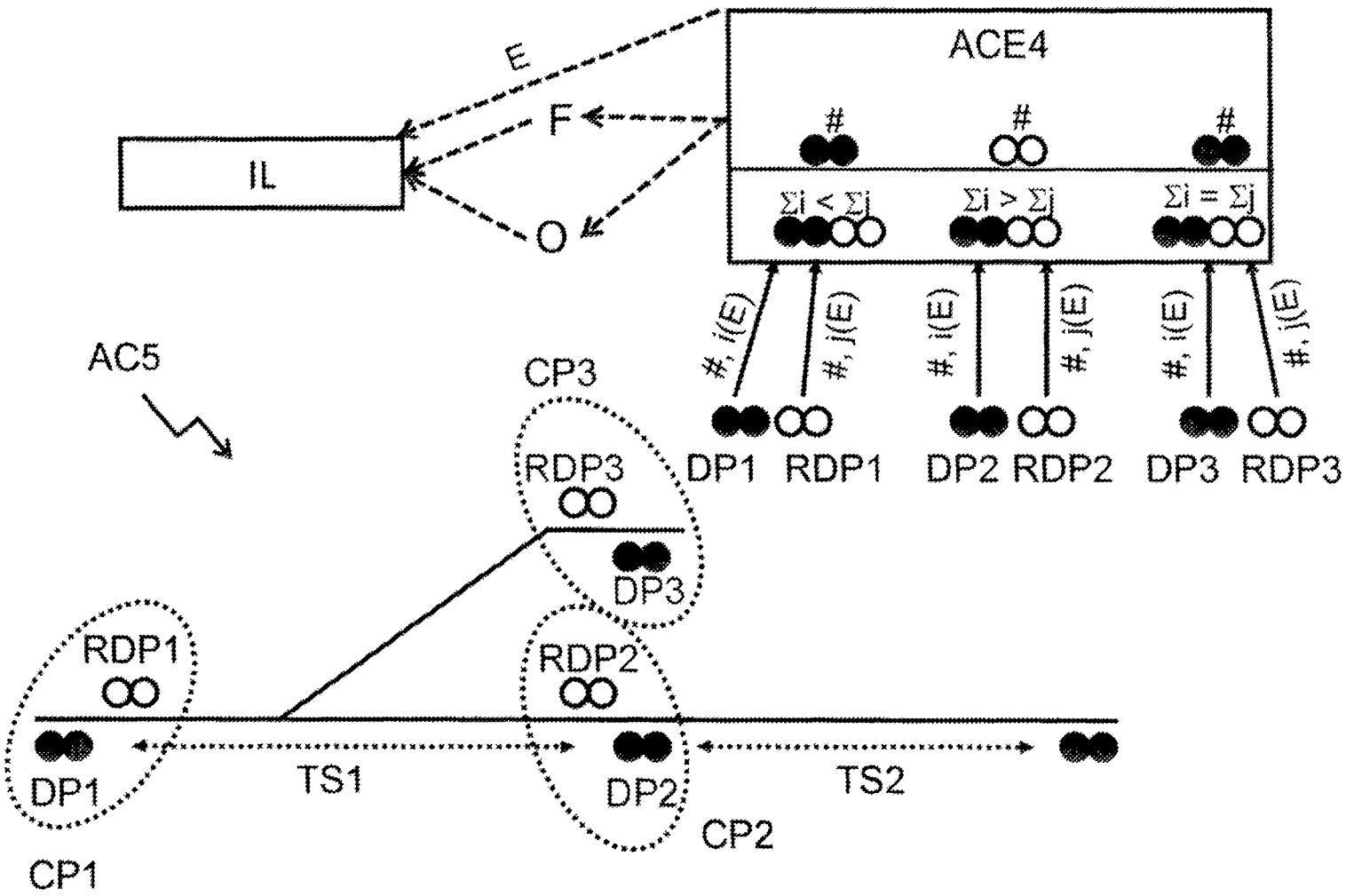
FIG. 6 shows a schematic drawing of further embodiment of the inventive axle counter system and method with determination of the quality factor.

FIG. 6 shows a schematic drawing of another embodiment of the inventive axle counter system AC5, wherein the selection of the detection points is carried out on the basis of quality values.

Each detection point DP1, DP2, DP3 and each redundant detection point RDP1, RDP2, RDP3 generate counter values # by counting passing axles. The counter values # of each detection point DP1, DP2, DP3, RDP1, RDP2, RDP3 are transmitted to the axle counter evaluator ACE4. Preferably the transmission of the axle counter values is carried out cyclically. Additionally, in case of an error, the detection points DP1, DP2, DP3, RDP1, RDP2, RDP3 in question report error messages E to the axle counter evaluator.

Every kind of error message is assigned a previously set quality factor i(E), j(E). The axle counter evaluator ACE4 adds the quality factors i(E), j(E) for each detection point DP1, DP2, DP3, RDP1, RDP2, RDP3 over a predetermined time, usually 30 s, in order to determine the quality value·i, ·j for every detection point DP1, DP2, DP3, RDP1, RDP2, RDP3.

The quality factors i(E), j(E) may be different for different kind of error messages, for example more safety-relevant error messages may be assigned a higher quality factor i(E), j(E) than less relevant error messages.

For counting position CP1, CP2 the detection point with the lowest quality value·i, ·j is selected (here: DP1, RDP2). At counting position CP3 for both, the basic detection point DP3 and the redundant detection point RDP3, the same quality value has been determined. In this case any of the detection points DP3, RDP3 can be selected (here: DP3).

The axle counter values # of each of the selected detection points DP1, RDP2, DP3 are used to determine the number of remaining axles in the track section TS1. According to the determined number of remaining axles the track section TS1 an occupation status free F or occupied O is reported to the interlock IL.

Additionally the error messages E of each detection point DP1, DP2, DP3, RDP1, RDP2, RDP3 are reported to the interlock IL, so that accordingly a reset of the corresponding detection points DP1, DP2, DP3, RDP1, RDP2, RDP3 may be initiated or a service can be scheduled if necessary.

Figure 7:
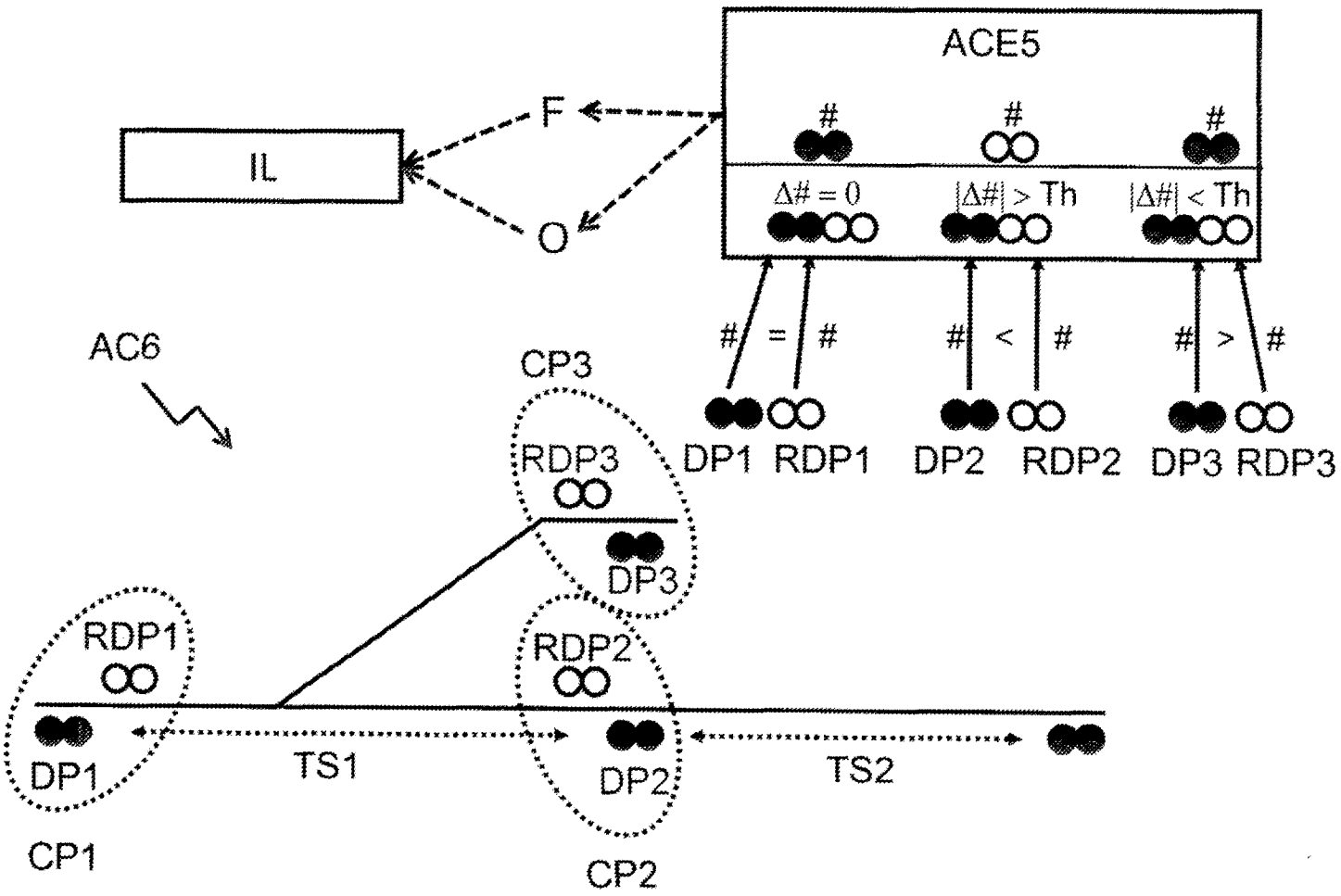
FIG. 7 shows a schematic drawing of an alternative embodiment to the embodiment of the inventive axle counter system and method with determination of the axle counter difference.

FIG. 7 shows a schematic drawing of yet another embodiment of the inventive axle counter system AC6. In this embodiment the selection of the detection points DP1, DP2, DP3, RDP1, RDP2, RDP3 is carried out on the basis of the difference Δ# of the axle counter values # of the basic detection point DP1, DP2, D3 and the related redundant detection point RDP1, RDP2, RDP3 of a counting position CP1, CP2, CP3. The axle counter value # of each basic detection point DP1, DP2, DP3 is compared to the axle counter value # of its related redundant detection point RDP1, RDP2, RDP3. If the absolute value of the difference of the axle counter values Δ# is greater than a predefined threshold Th the detection point DP1, DP2, DP3, RDP1, RDP2, RDP3 with the higher axle counter value # is selected. In the example depicted in FIG. 7, for counting position CP2 the axle counting value # of redundant detection point RDP2 is significantly greater than the axle counting value # of detection point DP2 and the absolute value of the difference of the axle counter values Δ# exceeds the threshold Th. Accordingly redundant detection point RDP2 is selected for counting position CP2.

For counting position CP3 the difference Δ# of axle counter values # of basic detection point DP3 and the related redundant detection point RDP3 is smaller than threshold Th. For counting position CP1 the axle counter values # of detection point DP1 and the related redundant detection point RDP1 are equal. In both cases the selection of the detection points can be carried out on the basis of a quality value as depicted in FIG. 6 and described above.

Again, the axle counter values of the selected detection points DP1, RDP2, DP3 is used to determine the number of remaining axles in the track section TS1. Accordingly, the occupation status F, O is reported to the related interlock IL.

This mechanism detects "blind" detection points.

Figure 8:
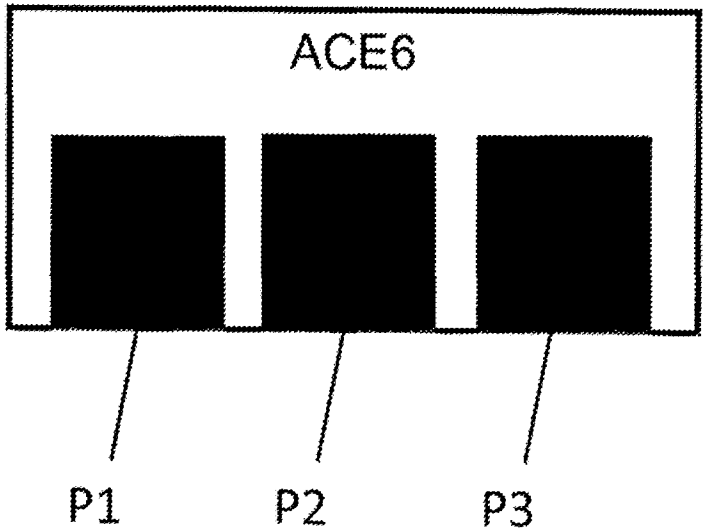
FIG. 8 shows a schematic drawing of an axle counter evaluator according to an embodiment of the inventive axle counter system.

FIG. 8 shows a schematic drawing of an axle counter evaluator ACE6 comprising three independent data processors P1, P2, P3. Each of the three processors carries out the same actions as described above, separately, so that a high safety and redundancy level is reached. For the embodiments of the inventive axle counter system shown in FIGS. 4 to 7 the axle counter evaluator ACE6 can be used instead of axle counter evaluator ACE3, ACE4, ACE5 respectively.

The inventive method carries out a selection of one detection point for each counting position. The choice which detection point will be selected depends on the status and the history of the both detection points of a set of redundant detection points: Initially, one of the two detection points will be taken if both detection points seem to be ok. If one detection point has a defect, the other one will be taken. A defect can be determined by comparing the counter values of the detection points of a counting position and/or by comparing a quality value based on error messages weighted with quality factors.

LIST OF REFERENCE SIGNS

AC Axle counter system
ACE Axle counter evaluator
CP Counting position
DP Basic detection point
DP' Additional detection point
RDP Redundant detection point
TS Track section
IL Interlock
F Occupation status: free O Occupation status: occupied
D defect
E Error messages of the listed detection points
i(E), j(E) Quality factor of error E
Σi(E), Quality value
Σj(E)
Axle counter value
Δ# Difference of axle counter value between basic detection point and the related redundant detection point
Th Threshold
P Data processor

What is claimed is:

1. A method for operating an axle counter system for monitoring the occupation status of a given track section, the track section being limited by counting positions, wherein at least one counting-in-position and a basic counting-out-position is provided, wherein at each counting position at least one detection point is provided and at least one counting position an additional detection point is provided, the basic and the additional detection point forming a set of redundant detection points, wherein each of the basic and additional detection points are a double sensor, said method comprising the steps of:

(a) incrementing or decrementing axle counter values by means of the detection points in dependence of the moving direction of a passing axle;

(b) transmitting the axle counter value of each detection point to an axle counter evaluator;

(c) selecting for each counting position exactly one basic or additional detection point for further processing independent of the selection at any other counting position, wherein the axle counter values of the of the selected basic or additional detection points are used for determining the number remaining axles within the track section and that the counter values of the non-selected detection basic or additional points of the at least one set of redundant detection points are ignored;

(d) determining the number of remaining axles within the track section by means of the axle counter evaluator by comparing the axle counter values of the selected basic or additional detection points at the counting-in-positions with those at the counting-out-positions; and (e) outputting a track occupation status report in dependence of the number of remaining axles within the track section.

2. The method according to claim 1, wherein a quality value is determined and the selection of the basic or additional detection points is carried out in dependence of a quality value.

3. The method according to claim 2, wherein in case of an error an error message is transmitted by the erroneous detection point to the axle counter evaluator, wherein a quality factor is assigned to each error message in dependence of the relevancy of the error, and that the quality value for each detection point is determined by adding the quality factors of the transmitted error messages of the respective detection point.

4. The method according to claim 3, wherein the error messages are at least one of: defect warning with quality factor QF1, wheel pulse without counting with quality factor QF2, drift warning with quality factor QF3 and long wheel pulse with quality factor QF4.

5. The method according to claim 4, wherein the following applies: QF1≠QF2≠QF3≠QF4.

6. The method according to claim 5, wherein the quality factors of the error messages comply with: QF1>QF2>QF3>QF4.

7. The method according to claim 5, wherein the quality factors of the error messages comply with: QF1:QF2:QF3:QF4=8:3:2:1.

8. The method according to claim 1, wherein for each set of redundant detection points the difference between the counter values of the basic and additional detection points of a set of redundant detection points is determined, and that the selection of the basic or additional detection points is carried out in dependence of the determined difference between the counter values, wherein the basic or additional detection point having the higher counter value is selected, in case that the difference of the counter values exceeds a predefined threshold.

9. The method according to claim 2, wherein for each set of redundant detection points the difference between the counter values of the basic and additional detection points of a set of redundant detection points is determined, and that the selection of the basic or additional detection points is carried out in dependence of the determined difference between the counter values, wherein the basic or additional detection point having the higher counter value is selected, in case that the difference of the counter values exceeds a predefined threshold, wherein in case that the difference does not exceed the predefined threshold the selection of the detection points is carried out in dependence of the quality value.

10. The method according to claim 1, wherein the selection of the basic or additional detection points and the calculation of the number of remaining axles in the section is performed by a common axle counter evaluator.

11. An axle counter system for performing the method according to claim 1, the axle counter system comprising detection points installed at counting positions along a track, wherein at each counting position a basic detection point is provided, and wherein at least one counting position an additional detection point is provided, the basic and the additional detection point forming a set of redundant detection points, wherein each of the basic and the additional detection points is a double sensor, wherein all detection points are connected to one common axle counter evaluator, the axle counter evaluator being equipped for selecting the basic or additional detection points and determining the number of remaining axles within the track section.

12. The axle counter system according to claim 11, wherein the axle counter evaluator is provided with means for determining a quality value.

13. The axle counter system according to claim 12, wherein the axle counter evaluator comprises at least two independent data processors.

14. The axle counter system according to claim 13, wherein the basic and additional detection points of a set of redundant detection points are installed at the same side of the track being spaced apart from each other.

15. The axle counter system according to claim 14, wherein the basic and additional detection points of a set of redundant detection points are installed at the opposite sides of the track.

16. The axle counter system according to claim 11, wherein the axle counter evaluator comprises at least two independent data processors.

17. The axle counter system according to claim 11, wherein the basic and additional detection points of a set of redundant detection points are installed at the same side of the track being spaced apart from each other.

18. The axle counter system according to claim 11, wherein the basic and additional detection points of a set of redundant detection points are installed at the opposite sides of the track.

19. A method for operating an axle counter system for monitoring the occupation status of a given track section, the track section being limited by counting positions, wherein at least one counting-in-position and at least one counting-out-position is provided, wherein at each counting position a basic detection point is provided and at least one counting position an additional detection point is provided, the basic and the additional detection points forming a set of redundant detection points, wherein each of the basic and additional detection points are a double sensor, said method comprising the steps of:

incrementing or decrementing axle counter values by means of the detection points in dependence of the moving direction of a passing axle;

transmitting the axle counter value of each detection point to an axle counter evaluator;

selecting exactly the basic or additional detection point for each counting position for further processing independent of the selection at any other counting position;

determining the number of remaining axles within the track section by means of the axle counter evaluator by comparing the axle counter values of the selected basic or additional detection points at the counting-in-positions with those at the counting-out-positions, wherein the counter values of the selected basic or additional detection points are used for determining the number of remaining axles within the track section and that the counter values of the non-selected basic or additional detection points are ignored; and outputting a track occupation status report in dependence of the number of remaining axles within the track section.

* * * * *